US007234735B2

(12) United States Patent
Harada

(10) Patent No.: US 7,234,735 B2
(45) Date of Patent: Jun. 26, 2007

(54) LOCKING DEVICE

(75) Inventor: Akinori Harada, Fujisawa (JP)

(73) Assignee: Nifco Inc., Yokohama (JP)

( * ) Notice: Subject to any disclaimer, the term of this patent is extended or adjusted under 35 U.S.C. 154(b) by 110 days.

(21) Appl. No.: 11/148,364

(22) Filed: Jun. 9, 2005

(65) Prior Publication Data

US 2006/0006663 A1 Jan. 12, 2006

(30) Foreign Application Priority Data

Jun. 18, 2004 (JP) ..... 2004-181731

(51) Int. Cl.
*E05C 1/12* (2006.01)
*E05C 1/08* (2006.01)

(52) U.S. Cl. ..... 292/170; 292/DIG. 37

(58) Field of Classification Search ..... 292/63, 292/57, 71, 65, 66, DIG. 37, 5, 170, DIG. 4; 296/37.12
See application file for complete search history.

(56) References Cited

U.S. PATENT DOCUMENTS 1,165,813 A * 12/1915 Stockburger ..... 292/71
2,136,662 A * 11/1938 Anderson ..... 292/64
2,252,591 A * 8/1941 Anderson ..... 292/63
4,095,827 A * 6/1978 Stavenau ..... 292/65
5,401,067 A * 3/1995 Kurosaki et al. ..... 292/63
5,688,001 A * 11/1997 Klein et al. ..... 292/67

FOREIGN PATENT DOCUMENTS

JP 11-159215 6/1999
JP 2003-40023 2/2003

* cited by examiner

*Primary Examiner*—Brian E. Glessner
*Assistant Examiner*—Alyson Merlino
(74) *Attorney, Agent, or Firm*—Manabu Kanesaka

(57) ABSTRACT

A locking device includes an operating button and a lock member disposed in a case. When the operating button is pressed against an urging force of a spring member, the lock member switches from a locked position for restricting a movable member to move relative to a body to an unlocked position for allowing the movable member to move in an opening direction. A rotation guide device is disposed between the case and the operating button, so that the lock member switches from the locked position to the unlocked position when the movable member rotates in a direction opposite to the opening direction.

5 Claims, 8 Drawing Sheets

LOCKING DEVICE

BACKGROUND OF THE INVENTION AND RELATED ART STATEMENT

The present invention relates to a locking device for locking a movable member such as a cover to a body in a closed state, and more particularly, relates to a locking device for unlocking a movable member through pressing an operating button.

A locking device shown in FIGS. 8(*a*) and 8(*b*) is disclosed in Patent Reference 1. The locking device includes an operating button 52 and a lock member 53 disposed in a case 51. When the operating button 52 is pressed against an urging force of a spring member 54, the lock member 53 switches from a locked position for restricting a cover 61 to rotate relative to a storage body 60 (refers to as a locked state) to an unlocked position for allowing the cover 61 to rotate in an opening direction (refers to an unlocked state).

The case 51 is formed of a recess portion including an open portion of the storage body 60, and slide slots 51*a* and 51*b* are formed in opposing walls of the recess portion. The lock member 53 has a tab 53*a* at a tip thereof for coming in and out of the slide slot 51*a*; a rear shaft 53*b* inserted into the slide slot 51*b*; and a coupling hole 53*c* disposed in a mid section thereof. The lock member 53 is moved toward the locked position by the urging force of the spring member 54 axially fitted in the shaft 53*b*, while the tab 53*a* and the shaft 53*b* are fitted in slide slots 51*a* and 51*b*, respectively.

The operating button 52 is formed of an operating section 52*a*; a sliding section 52*b* inserted into the coupling hole 53*c*; and an anti-slip tab 52*c* disposed at the rear end of the sliding section 52*b*. The operating button 52 is assembled in the lock member 53 such that a slanted end face of the sliding section 52*b* abuts against a slanted end face of the coupling slot 53*c*. In an assembled state, the lock member 53 is urged toward the locked position as shown in FIG. 8(*a*).

When the cover 61 is closed, the cover 61 rotates and abuts against the tab 53*a* just before the closed state, so that the lock member 53 retreats to the unlocked position due to a reactive force against the urging force of the spring member 54. When the lock member 53 faces the recess 62, the lock member 53 engages the recess 62. When the cover 61 is opened, the operating button 62 is pressed with a finger or the like, so that the lock member 53 retreats to the unlocked position against the urging force of the spring member 54, thereby releasing the lock member 53 from the recess 62 as shown in FIG. 8(*b*).

Patent Reference 1: Japanese Patent Publication (Kokai) No. 11-159215.

The locking device described above has a simple structure and the following problems. First, the lock member 53 is always urged toward the locked position to project from the case 51. During the opening operation of the cover, when a pressure is removed from the operating button 52 after pressing the same, the cover instantaneously returns to the original locked position with the urging force. Accordingly, depending on a rotational speed of the cover 61, the lock member may engage the recess 62 again, thereby restricting the rotation of the cover. In the locking device disclosed in Patent Reference 1, the cover 61 is a rotating type, and a sliding type may have the same problem.

Second, the operating button 52 is assembled in the lock member 53 such that the sliding section 52*b* is inserted into the coupling hole 53*c* and the slanted end faces abut against each other. Accordingly, dust or the like may accumulate, for example, between the slanted end faces. In this case, when the pressure is removed, the lock member 53 may not return to the original projected position or the locked position smoothly. Further, the lock member 53 may vibrate or move up and down, thereby causing malfunction.

Third, an elastic member may be disposed at a portion where the body abuts against the cover for absorbing an impact or preventing rattle. In such a case, when the cover is closed for a prolonged period of time, the elastic member may deform and deteriorate, thereby sticking the body and the cover together. Accordingly, even if the operating button is pressed to switch the lock member to the unlocked position, it is difficult to switch the lock member to the opened state.

In view of the problems described above, an object of the present invention is to provide a locking device with a simple structure capable of easily switching a movable member such as a cover to an open state, thereby improving quality and ease of use.

Further objects and advantages of the invention will be apparent from the following description of the invention.

SUMMARY OF THE INVENTION

In order to achieve the objects described above, according to a first aspect of the present invention, a locking device includes an operating button and a lock member disposed in a case. When the operating button is pressed against an urging force of a spring member, the lock member switches from a locked position for restricting a movable member to move relative to a body to an unlocked position for allowing the movable member to move in an opening direction. A rotation guide device is disposed between the case and the operating button, so that the lock member switches from the locked position to the unlocked position when the movable member rotates in a direction opposite to the opening direction.

In the present invention, the locking device described above is applicable to a type in which the movable member is connected to the body via a hinged section at one end and rotates about the hinged section, or a type in which the movable member moves in parallel to a corresponding section of the body. In applying the locking device, the lock member is disposed in the movable member or the body, and an engaging recess is disposed in the other part for engaging and disengaging from the lock member.

In the present invention, when the operating button is pressed, the lock member switches from the locked position to the unlocked position. At this time, the lock member switches from the locked position to the unlocked position through the rotation guide device while the movable member rotates in the direction opposite to the opening direction. When the lock member switches to the unlocked position with the rotation of the movable member, the lock member abuts against a corresponding surface of the recess to push the movable member in the opening direction through a reactive force of an abutting force.

According to the present invention, the locking device may have the following features. The rotation guide device may include a guide groove disposed in the case; a shaft projecting through the lock member and fitted within the guide groove so as to slide freely; an urging member for urging the lock member; and a projection disposed in the operating button and capable of pressing the shaft.

The guide groove may include a straight groove with a substantially linear shape and a curved groove with a check mark shape. The shaft may include a plurality of shafts corresponding to the straight and curved grooves. The urging device may have a first urging device for urging the lock member toward the locked position and a second urging device for urging the lock member toward the opening direction of the movable member. When the operating button is pressed, the lock member at the locked position retracts from the case once. Then, the lock member rotates in the direction opposite to the opening direction of the movable member while projecting from the case again and switching to the unlocked position.

In the present invention, the locking device has the following advantages. The lock member is switched from the locked position to the unlocked position with the rotation of the movable member in the direction opposite to the opening direction. The engaging recess is provided for engaging the lock member, so that the lock member abuts against the corresponding surface of the recess to push or bounce up the movable member in the opening direction through the reactive force, thereby solving the problems.

The rotation guide device is formed of a small number of parts. The urging member is provided for urging the lock member in addition to the spring member for urging the operating button, thereby eliminating malfunction. The urging member has the first and second urging devices, i.e., the first urging device for urging the lock member toward the locked position and the second urging device for urging the lock member not to rotate inadvertently. It is also possible to effectively bounce up the movable member with the lock member.

DETAILED DESCRIPTION OF PREFERRED EMBODIMENTS

Figure 1:
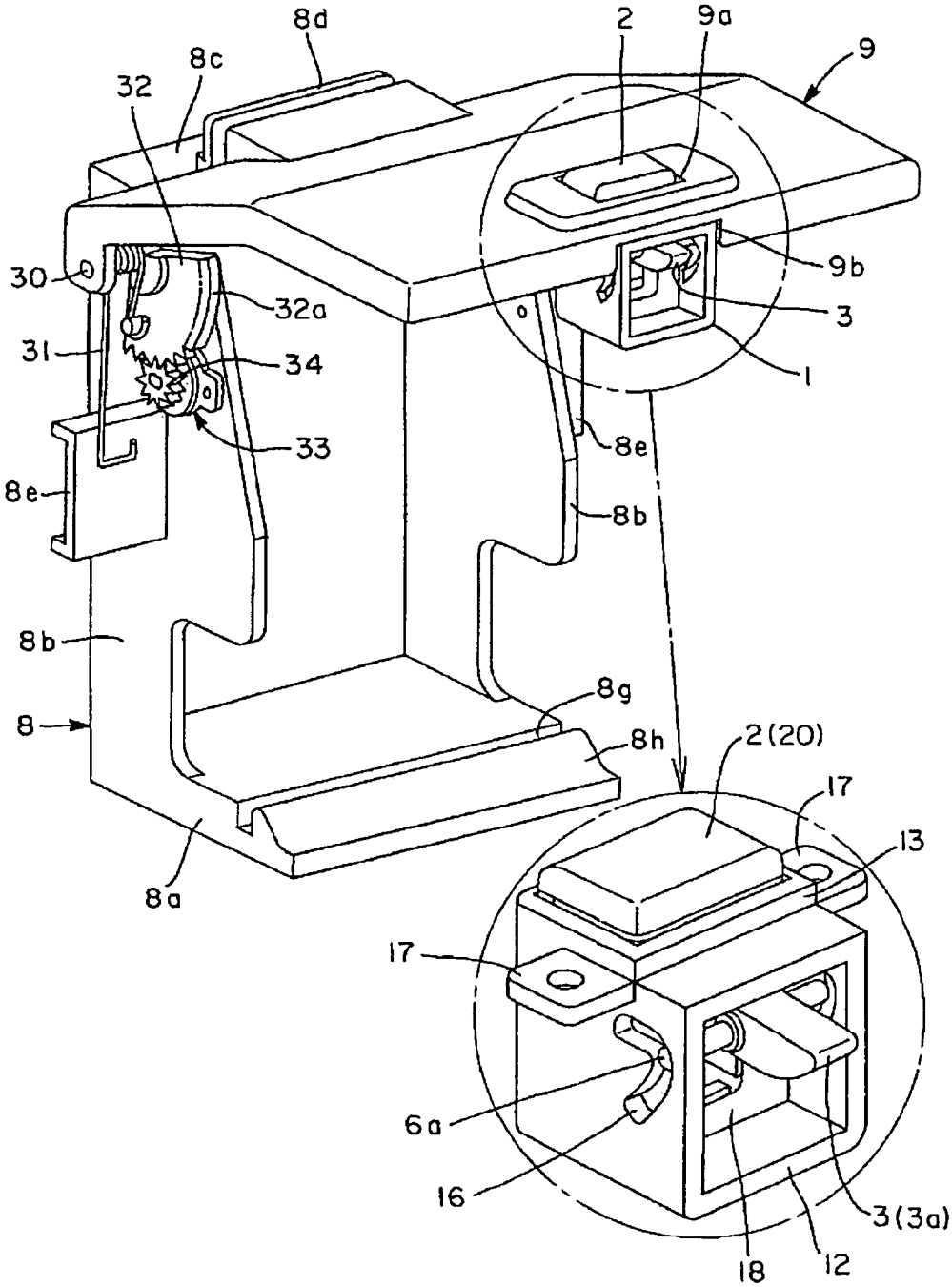
FIG. 1 is a view showing an apparatus with a locking device according to the present invention.
Figure 2:
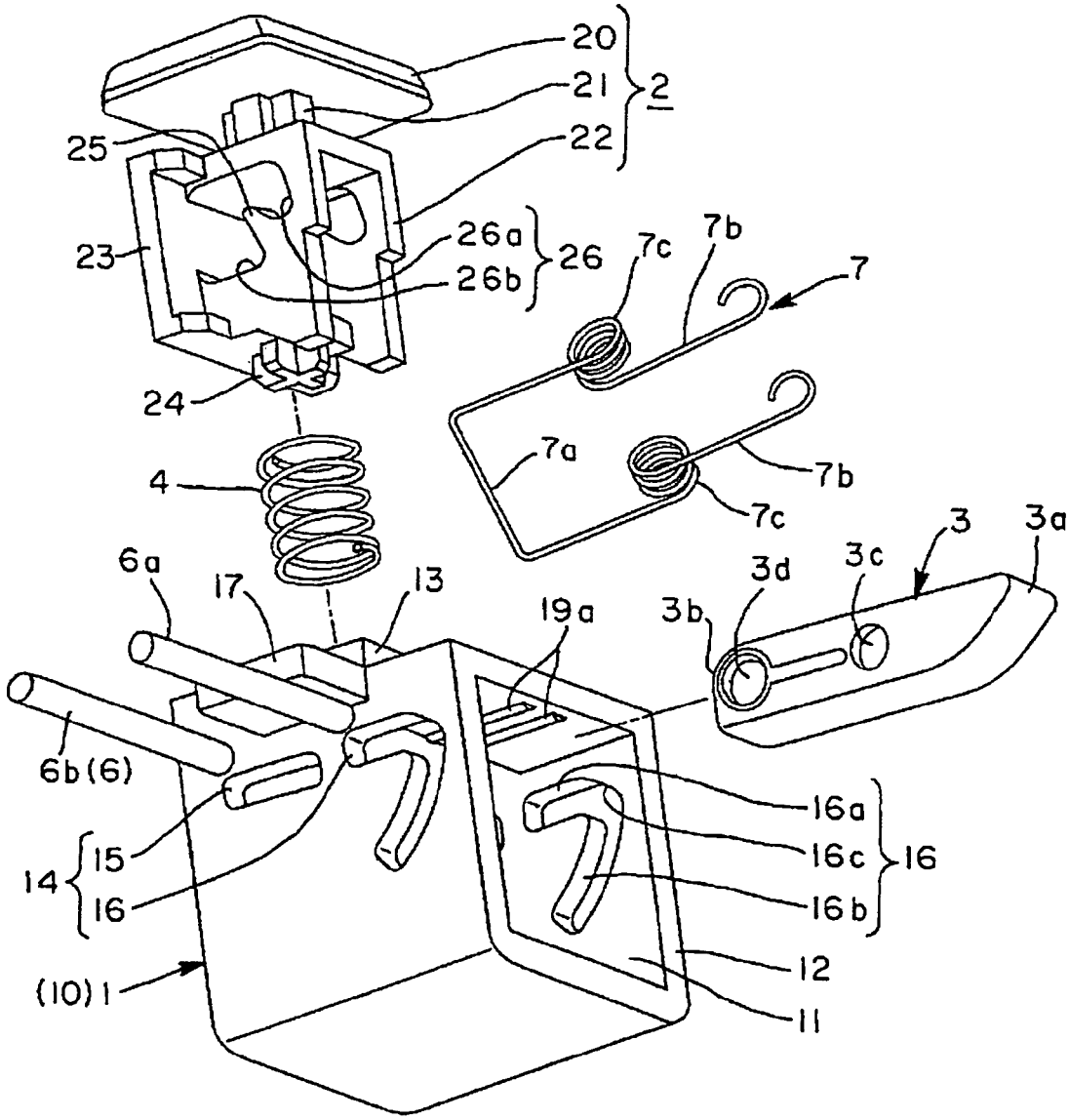
FIG. 2 is an exploded perspective view of the locking device.
Figure 3A:
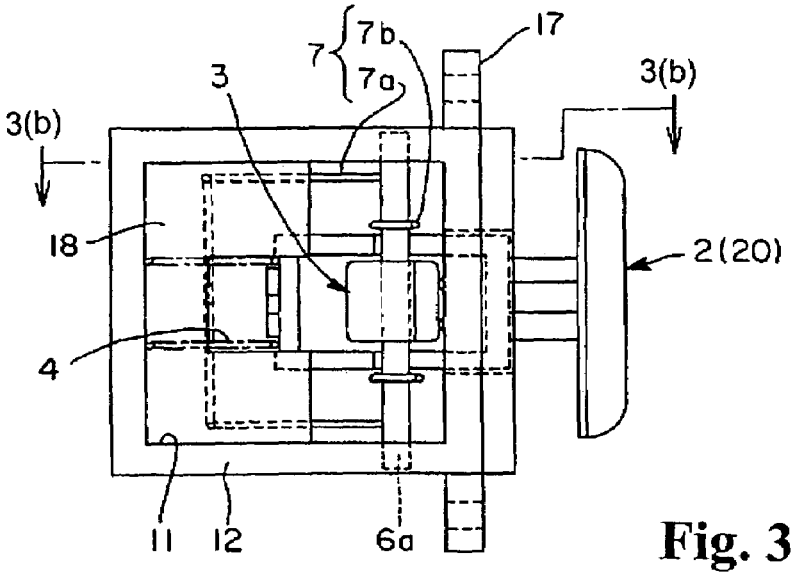
FIGS. 3(*a*) and 3(*b*) are views showing an operation of the locking device, wherein a lock member is at a locked position.
Figure 3B:
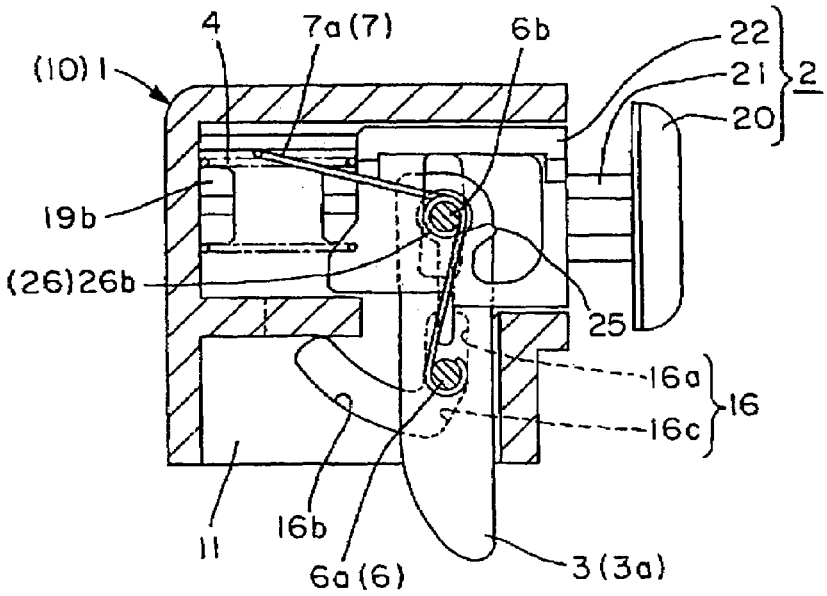

Hereunder, embodiments of the present invention will be explained with reference to the accompanying drawings. FIG. 1 is a schematic illustration of one example of the locking device according to the present invention applied to an appliance, and FIG. 2 is an exploded view showing the construction of the locking device. FIGS. 3(*a*), 3(*b*), 4(*a*) and 4(*b*) illustrate the locking device in the locked position and the initial position of unlocking (the bounced up position). FIGS. 3(*a*) and 4(*a*) are views of the lock member from the side out of which it projects, and FIGS. 3(*b*) and 4(*b*) are sectional views taken along lines 3(*b*)-3(*b*) and 4(*b*)-4(*b*), respectively. In the following explanation, the invention will be described in the order of summary, construction of the pertinent sections, assembly, and operation.

(Summary)

Figure 8A:
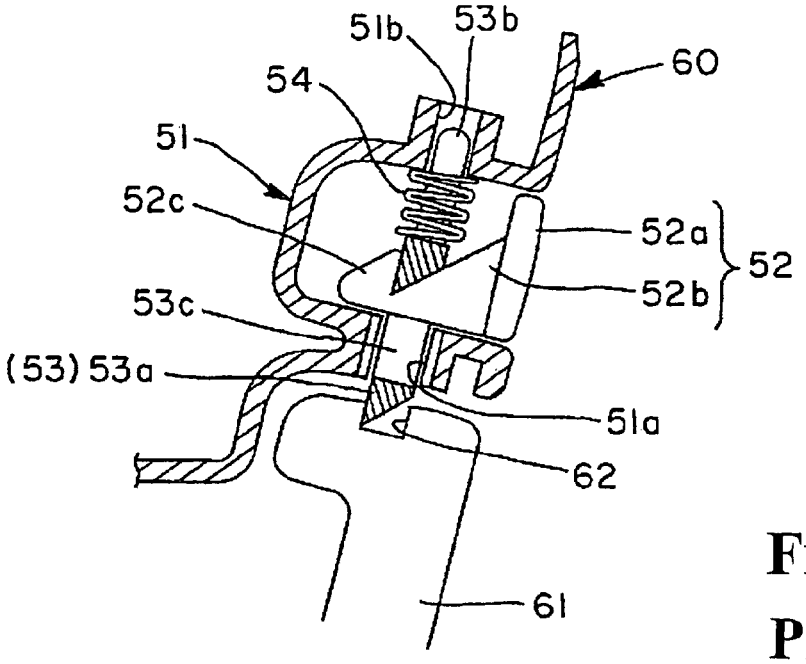
Fig. 8(a) Prior Art
FIGS. 8(*a*) and 8(*b*) are views showing a conventional locking device.
Figure 8B:
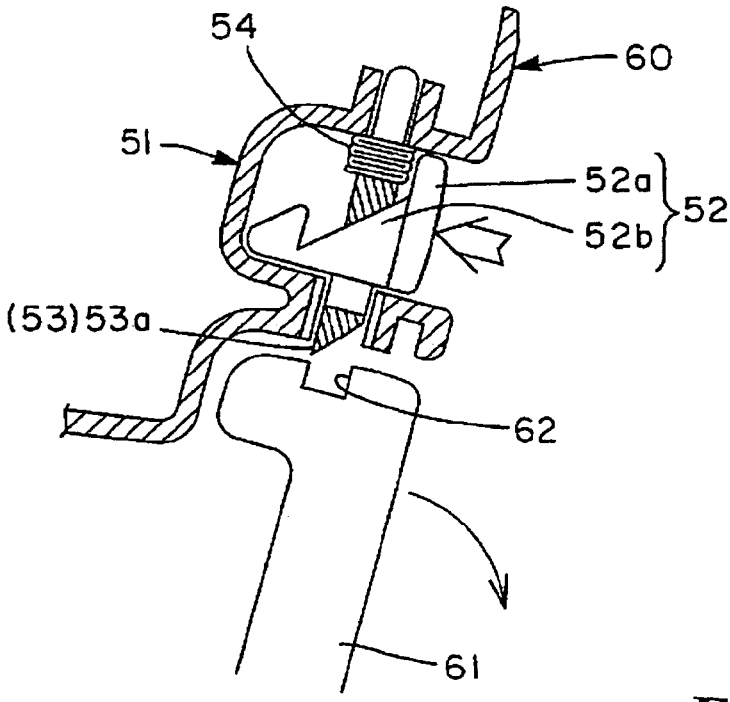
Fig. 8(b) Prior Art

The locking device in this embodiment includes an operating button 2 and a lock member 3 that are placed in relation with one another within a case 1, and is of the type that switches the lock member 3, through a pressing operation of the operating button 2 against the bias of a spring member 4, from the locked position where the rotation of a movable member, namely, a cover 9, is restricted relative to a body 8, to the unlocked position where the rotation of the cover 9 toward the opening direction is allowed. The comprising members are the case 1, the operating button 2, the lock member 3, and an urging device 7 that biases, together with a spring member 4, the lock member 3 and the shaft 6 additionally provided to the lock member 3. The case 1, the operating button 2, and the lock member 3 are of resin moldings, while the spring member 4, the urging member 7, and the shaft 6 are made of metal. The materials used, however, are not limited to these. Of the comprising members, the case 1 may be created integrally with the cover 9 by drawing an analogy to FIGS. 8(*a*) and 8(*b*), or created integrally with the body 8 of an appliance or a storage system as shown in FIGS. 8(*a*) and 8(*b*), in addition to being formed independently for exclusive use as shown in this embodiment.

The embodiment shown in FIG. 1 is an application example wherein the body 8 is open in the front, and the cover 9 opens and closes the front opening of the body 8 as it is turned about the pivot formed at the upper section. That is to say that the body 8 defines its inner section with a lower wall 8*a*, two side walls 8*b*, an upper wall 8*c* and the like, and has an engaging recess 8*g*, a slanted wall 8*h* that forms the area in front of the recess 8*g*, a projecting piece 8*e* projected from each of the two side walls, a damper 33 disposed above the projecting piece 8*e*, and a stopper 8*d* disposed in the upper wall 8*c*.

The cover 9 is pivoted by a shaft 30 at the projected sections provided on both sides so as to turn relative to the body 8, and includes a torsion spring 31 supported around the corresponding section of the shaft 30, and a fan-shaped gear piece 32 axially mounted to the shaft 30. The torsion spring 31 has a coiled section supported by the shaft 30, and one end of the coiled section is anchored to the boss projecting from the end face of the gear piece 32, and the other end of the coiled section is anchored to the projecting piece 8*e* while generating urging force. The gear piece 32 has teeth 32*a* formed continuously on the periphery thereof, and the teeth 32*a* engage the pinion 34 of the dumper 33. The cover 8 is normally urged to move in the opening direction by the urging force of the torsion spring 31; the cover is turned against the urging force to the closed state and locked by the locking device of the present invention.

(Construction of the Pertinent Sections)

The aforementioned locking device, as shown in FIGS. 1 to 3(*a*) and 3(*b*), is the same as the prior art mechanisms in terms of having the case 1 installed on the cover 9, the operating button 2 and lock member 3 interlocked within the case 1, and the spring member 4 for urging the operating button 2 outwardly from the case 1, but is different in the aspect of having a rotation guide device, which enables the switching of the lock member 3 from the locked position to the unlocked position with accompanying rotation in the reverse direction of the opening direction of the cover 9.

The rotation guide device comprises a guide groove 14 disposed on the case 1, plural shafts 6 (6*a* and 6*b*) that are projected through the lock member 3 and fitted into guide groove 14 so as to slide freely, an urging device 7 that biases the lock member 3, and a projection 25 disposed on the operating button 2 and capable of pressing the shaft 6.

The case 1 has a hexagonal shape having a body 10 and a hollowed inner section 11. Of the six planes, the side plane 12, from which the lock member 3 projects, is open, and the side plane that is about 90 degrees off of the side plane 12 is open through a frame 13. Each of the opposing walls (two side walls) on both sides of the side plane 12 is provided with the guide groove 14 and a mounting piece 17 located near the frame 13. The guide groove 14 comprises a straight groove 15, which is substantially linear, and a curved groove 16, which has a reversed check mark shape.

The straight groove 15 is disposed substantially in parallel to the frame 13 or the corresponding edge of the hexahedron. The curved groove 16 is disposed in a spaced apart relation to the straight groove 15, and has a linearly extending straight section 16*a*, an arc section 16*b* extending from the corresponding end of the straight section 16*a* toward the opposite side of the frame 13, and a slanted section 16*c* defining and forming the outer corner between the straight section 16*a* and the arc section 16*b*.

In the inner section 11, a partition 18 (roughly forms a recessed shape) is provided at a location slightly inward from the side plane 12 to project to the level that is substantially the same as the inner side of the frame 13 so as to leave a space for the placement and movement of the lock member 3, as shown in FIGS. 3(*a*) and 3(*b*), and two ribs 19*a* are provided on the inner surface of the side plane where the frame 13 is disposed, as shown in FIG. 2. Reference numeral 19*b* is a spring anchor projected from the inner wall of the side plane from which the partition 18 projects.

The operating button 2, as shown in FIG. 2, has an operating section 20, which is the location pushed by a finger or the like, a neck 21 projecting from the inner face of the operating section 20, and a body 22 connected at the lower end of the neck 21. The operating section 20 is a substantially rectangular plate that can be inserted into the frame 13. The neck 21 is formed to have a roughly cross-shaped cross section. The body 22 roughly forms in a rectangular shape. The lower end of the neck 21 is connected to the mid piece between the rectangular shape, and the body also has a plate 23 which is broader in width than the rectangular shape and is integrated with the back faces or the rear sides of the rectangular shape.

Each side of the rectangular shape has a run off 26 so that they oppose one another and are penetrable from side to side. Each run off 26 is composed of a front run off 26*a* and a rear run off 26*b*. Run off 26*a* and run off 26*b* are contiguous in the upper section, and are defined by the projection 25 disposed upwardly at an angle between the two. Reference numeral 24 is a spring anchor located below the sides of the rectangular shape and projecting from the plate that connects the sides.

The lock member 3 is shaped, overall, as a bar, and the tip section 3*a* is tapered from one side to the other. It also has plural shaft holes 3*c* and 3*d* that are respectively disposed roughly in the longitudinal mid section and the base section 3*b*, and are penetrable from side to side in the condition shown in FIG. 2 (or from front to back in the condition shown in FIGS. 3(*a*) and 3(*b*)). The lock member 3 is sized so that its thickness is accommodated within the rectangular shape of the body 22, with a margin, and its total length allows the tip side to project out of the opening of the side 12 under the condition wherein the base 3*b* is situated within the rectangular shape of the body 22 within the case 1.

The spring member 4 is a coil spring and biases the operating button 2 in the direction to project from inside to outside the case 1. The urging device 7 integrally forms a first pair of urging sections 7*a* urging the lock member 3 in the direction to project from the inside to the outside of the case 1, namely, the aforementioned direction toward the locked position, a second pair of urging sections 7*b* urging the lock member 3 toward the opening direction of the cover 9, and a pair of coiled sections 7*c* disposed between the first pair of urging sections 7*a* and the second pair of urging sections 7*b*. The urging device 7 is only required to have a coil section 7*c* to be supported by the shaft 6*b*, a first urging section 7*a* disposed at one end of the coiled section 7*c* and abutted against the corresponding inner wall of the case 1, and a second urging section 7*b* disposed at the other end of the coiled section 7*c* and anchored to the shaft 6*a*.

(Assembly)

The parts described above are assembled in the following manner. First, the operating button 2 is installed in the case 1 together with the spring member 4. In this step, for example, the operating button 2 is inserted and situated in the inner section 11 through the frame section 13 under the condition wherein the corresponding end of the spring 4 is mounted to the spring anchor 24. The spring member 4 biases the operating button 2 in the direction opposite to the insertion upon achieving the condition wherein the other end engages the spring anchor 19*b*.

Next, the lock member 3 and the urging member 7 are inserted into the case 1 through the opening at the side plane 12. In this case, the urging device 7 is situated so that the coiled sections 7*c* on both sides are positioned outside of the two sides of the rectangular shape of the body 22, and the lock member 3 is situated so that the base 3*b* is positioned between the two sides of the rectangular shape of the body 22. Then, the operating button 2 and the lock member 3 are coupled via the shafts 6 that are fitted with the guide grooves 14. In this step, for example, the shaft 6*b* is inserted through in the order of the straight groove 15 on one side of the case, the coiled section 7*c* on that side, the run off 26*b* on that side, the shaft hole 3*d*, the run off 26*b* on the other side, the coiled section 7*c* on that side, and the straight groove 15 on that side of the case. Then, the free ends of the second pair of urging sections 7*b* are anchored to the corresponding sections of the shaft 6*a*. The assembly is completed with this anchoring operation.

The locking device described above is installed in such a way that the case 1 is disposed in the recessed section 9*b* provided for positioning created at the inner face of the cover 9, and mounted to the cover 9 with screws or the like that are inserted from the holes in the mounting pieces 17, as is clear in FIG. 1. In the installed condition, the operating button 2 is exposed at the through hole 9*a* created in the center of the recessed section 9*b*.

(Operation)

Figure 4A:
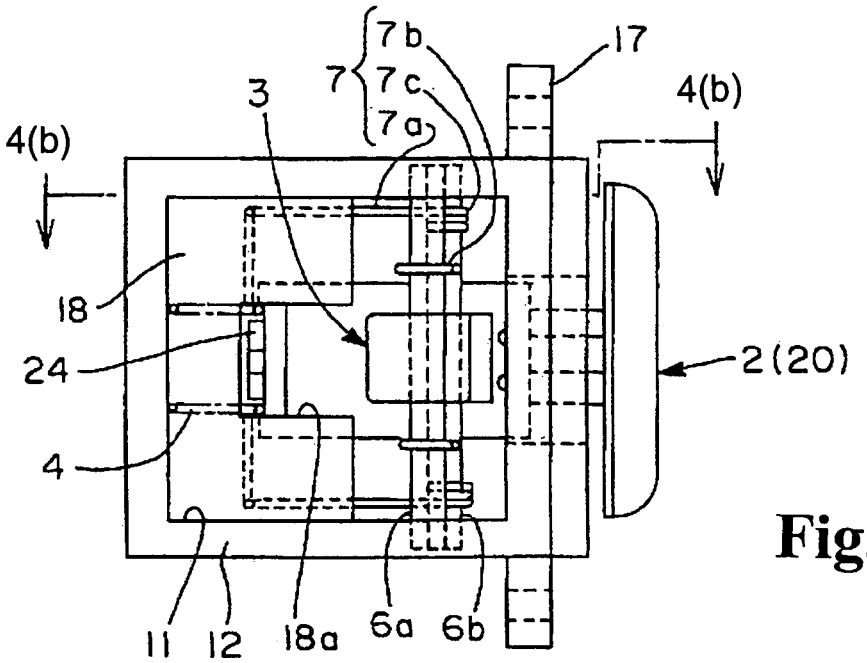
FIGS. 4(*a*) and 4(*b*) are views showing an operation of the locking device, wherein the lock member is at an unlocked position.
Figure 4B:
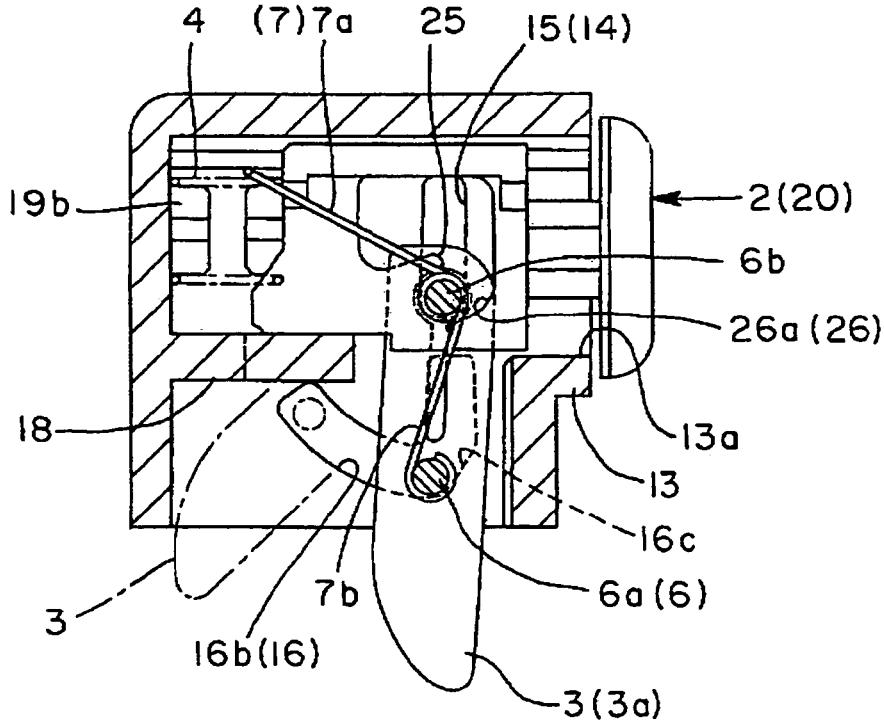
Figure 5A:
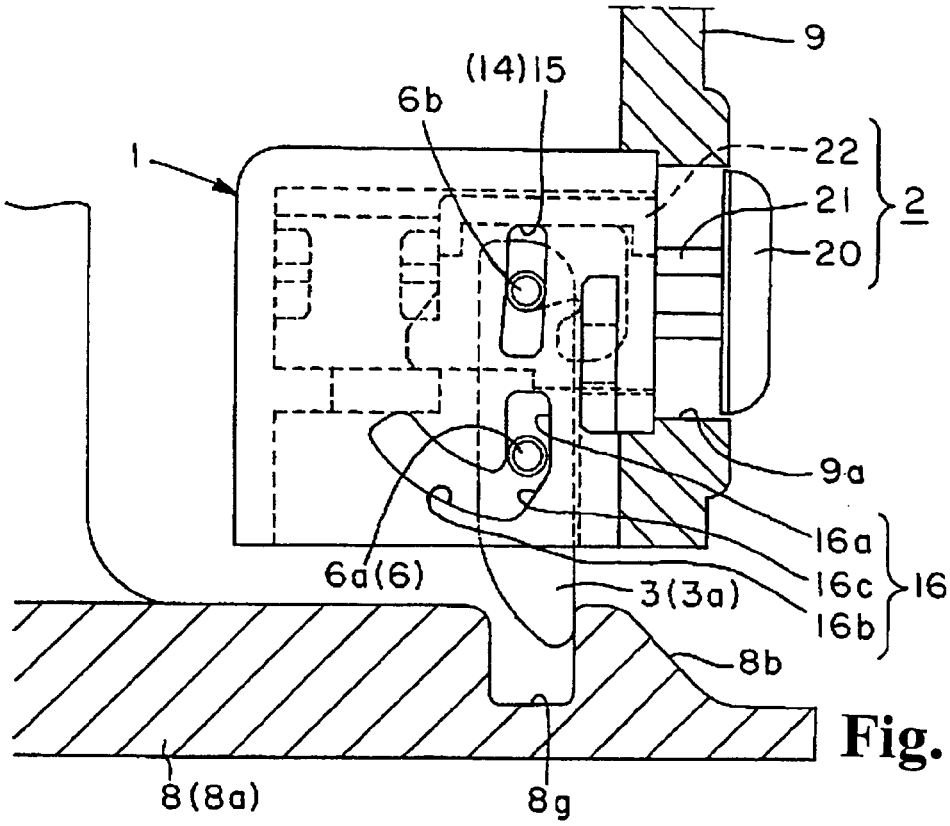
FIGS. 5(*a*) and 5(*b*) are views showing an operation of the locking device.
Figure 5B:
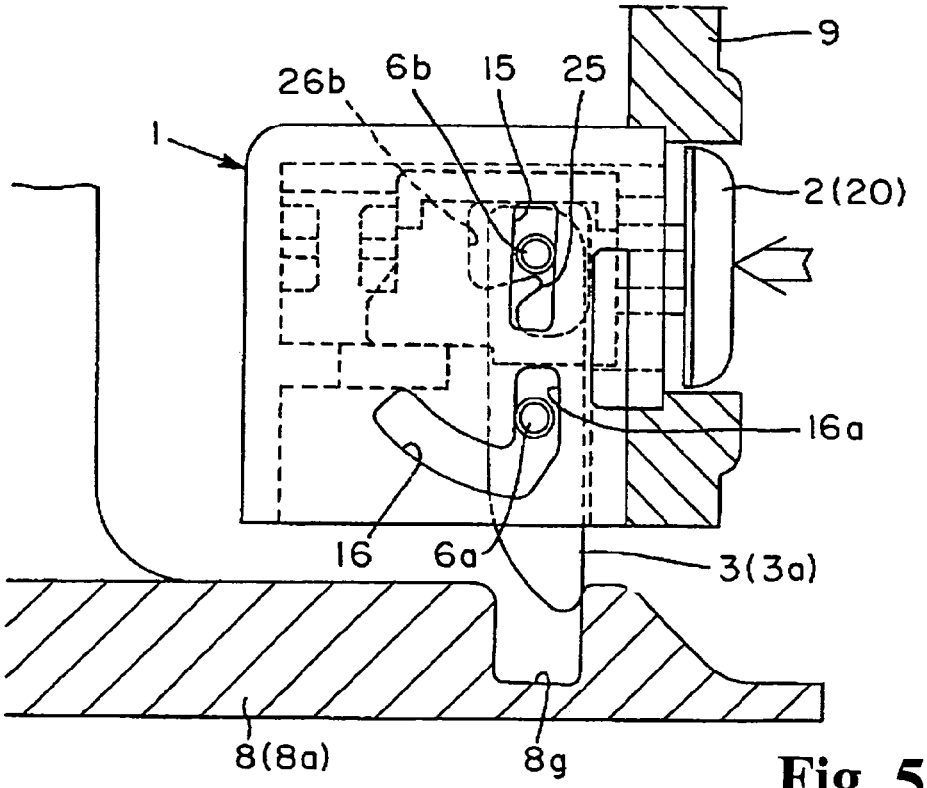
Figure 6A:
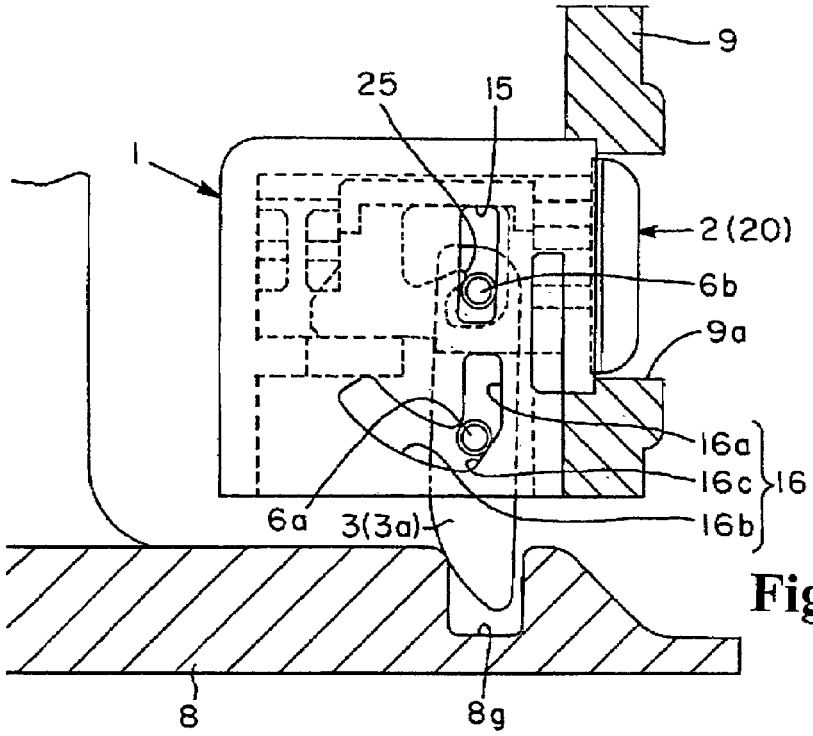
FIGS. 6(*a*) and 6(*b*) are views showing an operation of the locking device.
Figure 6B:
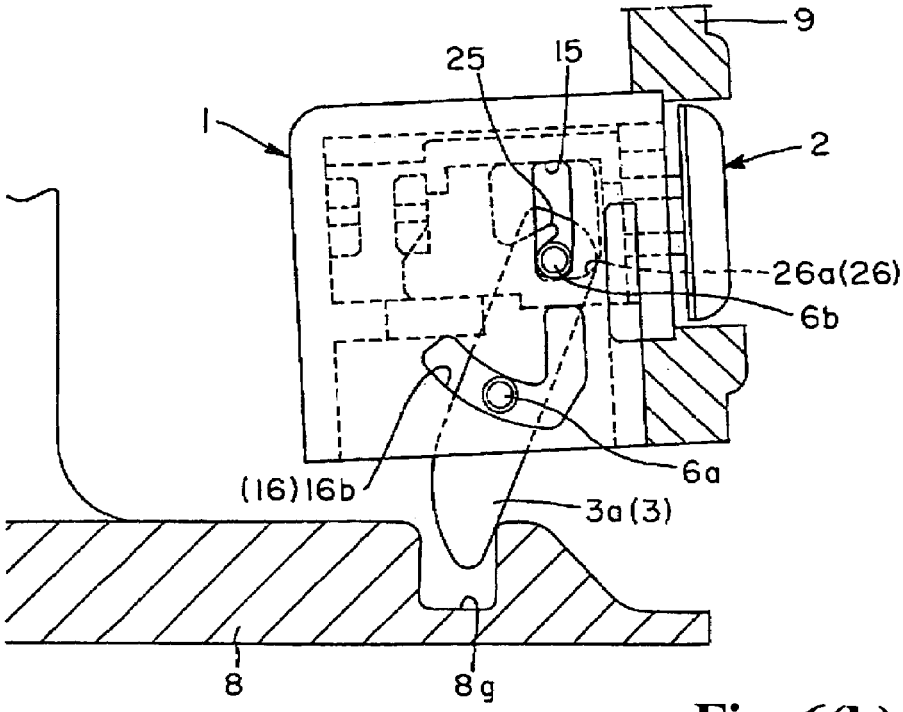
Figure 7A:
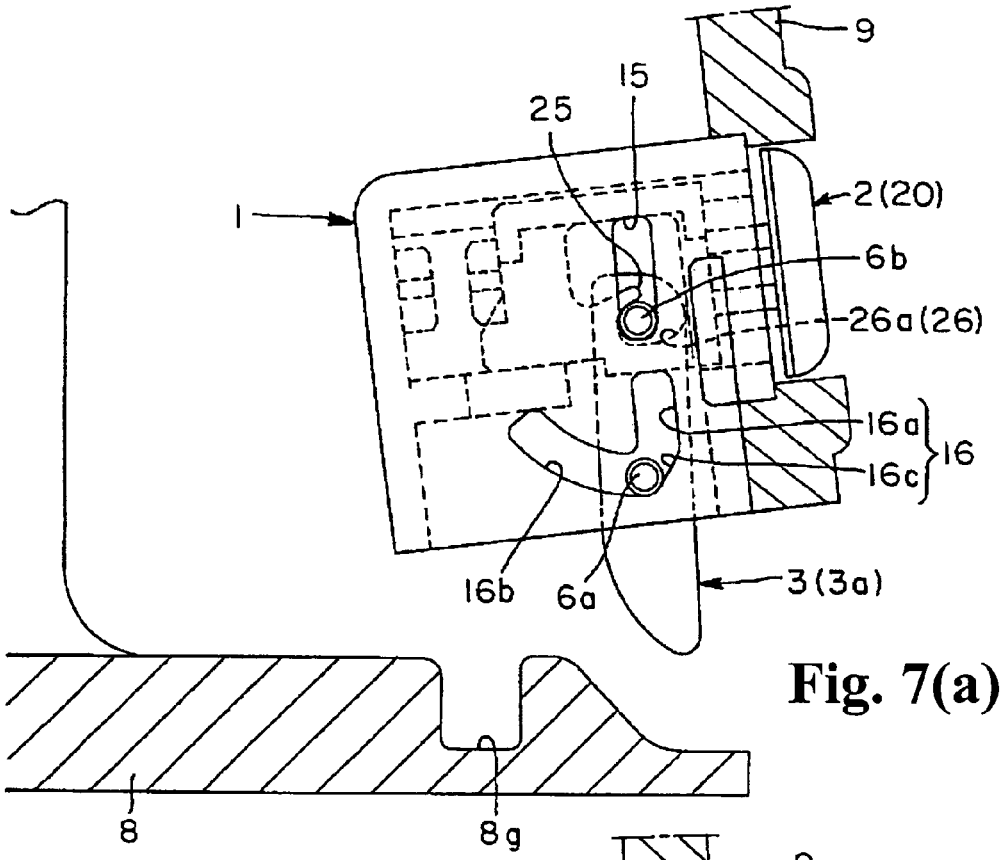
FIGS. 7(*a*) and 7(*b*) are views showing an operation of the locking device when a cover is closed.
Figure 7B:
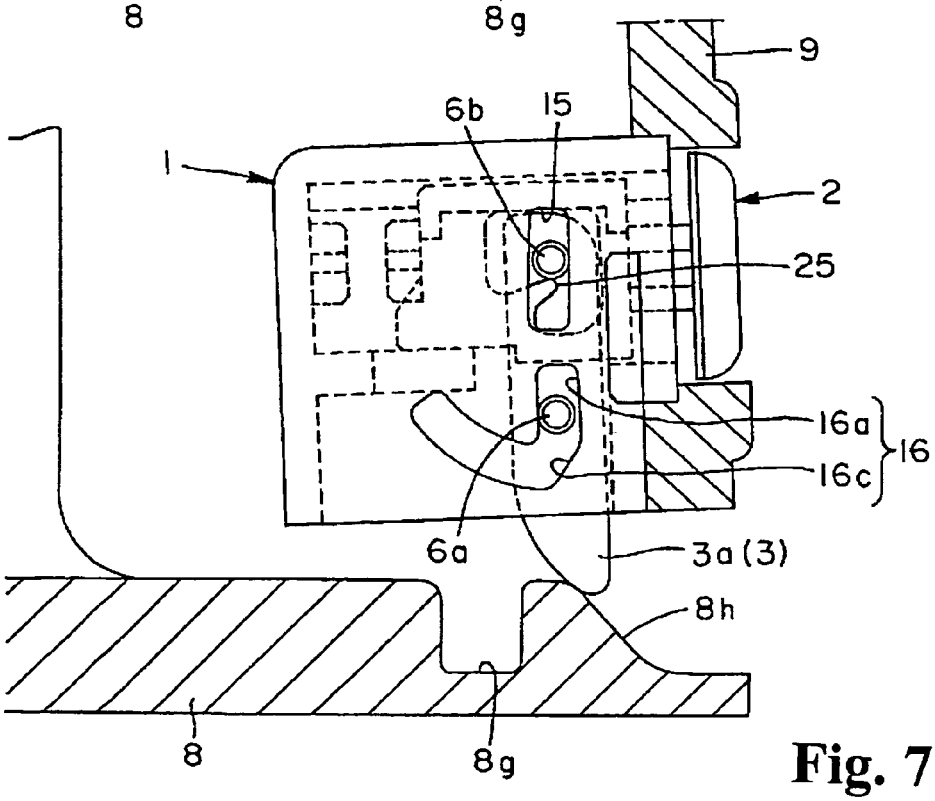

Next, the operation of the above described locking device will be explained in detail with reference to FIGS. 5(*a*) and 5(*b*) to 7(*a*) and 7(*b*). FIG. 5(*a*) is a schematic side view of the mechanism when the lid is closed (the locking device is in the closed position), which is the same condition as that shown in FIG. 3, and FIG. 5(*b*) is a schematic side view showing the condition wherein the operating button is pressed. FIGS. 6(*a*) and 6(*b*) show the process wherein the cover is switched from the closed state to the opened condition; wherein FIG. 6(*a*) is a schematic side view showing the bouncing operation of the lock member, the same condition as that shown in FIG. 4(*a*), and FIG. 6(*b*) is a schematic side view showing the condition wherein the lock member is further turned in the reverse direction of the rotation of the cover. FIGS. 7(*a*) and 7(*b*) are schematic side views showing the condition immediately before the cover is closed. The spring member and the urging member are omitted in FIGS. 5(*a*) and 5(*b*) to 7(*a*) and 7(*b*) to better explain the operation.

In the above described locking device, when assembled, as shown in FIG. 3(*a*) and FIG. 5(*a*), the shaft 6*b* is urged and moved within the straight groove 15 to roughly the longitudinal mid position (this position of the shaft 6*b* is restricted by the rear run off 26*b* of the body 22) under the condition wherein the first urging sections 7*a* are abutted against the corresponding inner surfaces within the case 1. As a result, the lock member 3 engages the recess 8*g* on the body side via the movement of the shaft 6*b* and is held at the locked position that restricts the rotation of the cover 9. The second urging sections 7*b* slightly move the shaft 6*a* within the curved groove 16 from the slanted section 16*c* to the straight section 16*a*. As a result, the lock member 3 is held so as not to be inadvertently turned by the movement of the shaft 6*a* from the aforementioned locked position to the unlocked position.

In the locking device, to switch to the locked position to allow for the rotation of the cover 9, the operating section 20 of the operating button 2 is pressed in the direction indicated by the arrow in FIG. 5(*b*) in the locked position that restricts the rotation of the cover 9. The lock member 3 reduces the amount of projection projecting from the case 1 , rotates in the reverse direction of the opening direction of the cover 9 while increasing the amount of projection projecting from the case 1 , as shown in FIGS. 4(*b*) and 6(*a*), and abuts against the corresponding surface of the recess 8*g* as a result of the rotation. As, a result, the lock member 3 pushes out the cover 9 to an open position using the reactive force of the abutting force.

In other words, in the locking device described above, once the operating button 2 (the operating section 20) is pressed against the urging force of the spring member 4, the projection 25, in an interlocking relation with the retreating motion of the body 22 within the case 1, operates to push up the shaft 6*b* from below within the run off 26*b* utilizing the projected distance thereof (the shaft 6*b* and the shaft 6*a* are slightly moved up in the straight groove 6*a* and the straight section 16*a* of the curved groove 16, respectively). As a result, the lock member 3 reduces the amount of projection projecting from the case 1 (see FIG. 5(*b*)). Then, once the projection 25 passes the shaft 6*b*, the shaft 6*b* drops into the run off 26*a* and is moved to the lower end of the straight groove 15 in response to the downward bias applied by the first urging sections 7*a*. At the same time, the shaft 6*a* is moved from the straight section 16*a* to the slanted section l6*c* of the curved groove 16, as shown in FIG. 4(*b*) and FIG. 6(*a*).

As a result, the lock member 3, which has been in the condition shown in FIG. 5(*b*), rotates in the direction that is opposite to the opening direction of the cover 9 while increasing the amount of projection projecting from the case 1 again. This rotation causes the lock member 3 to abut against the corresponding inner surface of the recess 8*g* (the rear surface of the two opposing inner surfaces), and, using the reactive force gained at this point, pushes out the cover 9 in the opening direction, i.e., causes the cover 9 to bounce up. Subsequently, the lock member 3 abuts against the corresponding inner face of the recess 8*g* (the front surface of the two opposing inner surfaces) in the initial stage of the rotation of the cover 9 in the opening direction resulting from the urging force of the torsion spring 31, as shown in FIG. 6(*b*). Then, the shaft 6*a* is moved along the arc section 16*b* of the curved groove 16 by using the shaft 6*b*, which has been moved to the lower section of the straight groove 15, as the pivot, and against the bias of the aforementioned second urging sections 7*b*, and, as a result, the lock member 3 is unlocked as it goes over the recess 8*g* while rotating in the direction to reduce the amount of projection projecting from the case 1, or the direction that is opposite of the opening direction of the cover 9.

Once the lock member 3 is unlocked from the recess 8*g* in the manner described above, the shaft 6*a* is returned from the arc section 16*b* to the slanted section 16*c* of the curved groove 16 by the bias of the second urging sections 7*b*, as shown in FIG. 7(*a*). In the locking device, therefore, when the cover 9 is turned from the open state in the closing direction, and the lock member 3 receives upward stress as the tip 3*a* thereof abuts against the slanted wall 8*h* of the body 8, as shown in FIG. 7(*b*), the shaft 6*b* and the shaft 6*a* respectively move to the upper section of the straight groove 15 and from the slanted section 16*c* to the straight section 16*a*, and, as a result, the lock member 3 reaches above the recess 8*h* while reducing the amount of projection projecting from the case 1. At the same time, the lock member is switched to the locked position where it is engaged with the recess 8*g*, as shown in FIG. 5(*a*), as the shaft 6*b* moves downwardly using the bias of the aforementioned first urging sections 7*a*, and the shaft 6*a* turns to move to the initial position using the bias of the aforementioned second urging sections 7*b*.

The disclosure of Japanese Patent Application No. 2004-181731, filed on Jun. 18, 2004, is incorporated in the application.

While the invention has been explained with reference to the specific embodiments of the invention, the explanation is illustrative and the invention is limited only by the appended claims.

What is claimed is:

1. A locking device for locking a movable member relative to a body member, comprising:

a case, an operating button disposed in the case and projecting from the case, a spring member disposed in the case for urging the operating button to project outwardly, a lock member disposed in the case and connected to the operating button, said lock member switching from a locked position for restricting movement of the movable member to an unlocked position for allowing the movable member to move in an opening direction when the operating button is pushed against an urging force of the spring member, and a rotation guide device disposed between the case and the operating button for guiding the lock member from the locked position to the unlocked position while the lock member moves in a direction opposite to the opening direction of the movable member when the lock member is unlocked, wherein said rotation guide device includes a guide groove disposed in the case, a shaft member passing through the lock member and fitted into the guide groove to slide freely, an urging member for urging the lock member in one direction, and a projection disposed on the operating button for pressing the shaft member, and wherein said guide groove includes a straight groove portion having a substantially linear shape, and a curved groove portion having a front portion and a rear portion extending rearwardly from an end of the front portion, and said shaft member includes first and second shafts disposed in the straight groove portion and the curved groove portion.

2. A locking device according to claim 1, wherein said straight groove portion and said front portion extend in a same direction.

3. A locking device according to claim 1, wherein said urging device includes a first urging section for urging the lock member toward the locked position, and a second urging section for urging the lock member toward the unlocked position.

4. A locking device according to claim 3, wherein said urging device further includes a coiled section disposed on the first shaft, and an end connected to the second shaft.

5. A locking device according to claim 1, wherein said lock member is arranged such that the lock member in the locked position retracts into the case when the operating button is pressed, and said lock member rotates in the direction opposite to the opening direction to switch to the unlocked position while projecting from the case again.

* * * * *